US007513648B2

(12) United States Patent
Rotgeri et al.

(10) Patent No.: US 7,513,648 B2
(45) Date of Patent: Apr. 7, 2009

(54) HEADLAMP FOR VEHICLES

(75) Inventors: Gerhard Rotgeri, Geseke (DE); Martin Dobrescu, Lippstadt (DE); Markus Gösling, Lippstadt (DE); Wolfgang Daub, Anröchte (DE)

(73) Assignee: Hella KGaA Hueck & Co.,, Lippstadt (DE)

( * ) Notice: Subject to any disclaimer, the term of this patent is extended or adjusted under 35 U.S.C. 154(b) by 151 days.

(21) Appl. No.: 10/557,301

(22) PCT Filed: May 18, 2004

(86) PCT No.: PCT/EP2004/005351

§ 371 (c)(1),
(2), (4) Date: Nov. 13, 2006

(87) PCT Pub. No.: WO2004/104475

PCT Pub. Date: Dec. 2, 2004

(65) Prior Publication Data

US 2007/0064436 A1 Mar. 22, 2007

(30) Foreign Application Priority Data

May 20, 2003 (DE) ..... 103 22 627

(51) Int. Cl.
*F21S 8/00* (2006.01)

(52) U.S. Cl. ..... 362/263; 362/509; 362/459; 362/475; 362/507; 362/523; 362/519; 362/265

(58) Field of Classification Search ..... 362/263, 362/459, 475, 476, 507, 523, 519, 265
See application file for complete search history.

(56) References Cited

U.S. PATENT DOCUMENTS 1,822,161 A 9/1931 Mayer
5,237,489 A 8/1993 Stein et al.

(Continued)

FOREIGN PATENT DOCUMENTS

DE 196 54 190 A1 7/1997

(Continued)

OTHER PUBLICATIONS

International Search Report PCT/EP2004/005351 dated May 18, 2004 (No English Translation).

(Continued)

*Primary Examiner*—Stephen F Husar
*Assistant Examiner*—Jessica L McMillan
(74) *Attorney, Agent, or Firm*—Husch Blackwell Sanders LLP; Robert C. Haldiman, Esq.

(57) ABSTRACT

The invention concerns a headlamp for vehicles with a reflector comprising a reflector opening for receiving a gas discharge lamp, with an ignition device for operating the gas discharge lamp, with holding means for releasably connecting the ignition device to a reflector, with electromagnetically compatible contact means arranged between the ignition device and the reflector, wherein the holding means includes a holding element which together with the ignition device and the gas discharge lamp forms a common unit, and the electromagnetically compatible contact means is integrated in the holding element, in such a way that, in a locking position of the holding element with the reflector, there is an electrically conductive connection between the ignition device and the reflector.

21 Claims, 4 Drawing Sheets

U.S. PATENT DOCUMENTS

| | | | | |
|---|---|---|---|---|
| 6,390,657 | B1 | 5/2002 | Billot | |
| 6,474,856 | B2 | 11/2002 | Billot | |
| 6,727,601 | B2 * | 4/2004 | Rothfuss et al. | 307/10.1 |
| 2002/0012249 | A1 * | 1/2002 | Brummel et al. | 362/459 |

FOREIGN PATENT DOCUMENTS

| | | | |
|---|---|---|---|
| DE | 197 37 640 | A1 | 3/1998 |
| DE | 201 07 817 | U1 | 8/2001 |
| DE | 202 08 295 | U1 | 9/2002 |
| JP | 07 114819 | A | 5/1995 |
| WO | WO 98/38708 | | 9/1998 |
| WO | WO 02/37024 | A1 | 5/2002 |

OTHER PUBLICATIONS

German Search Report 103 22 627.3 dated May 5, 2003 (No English Translation).

* cited by examiner

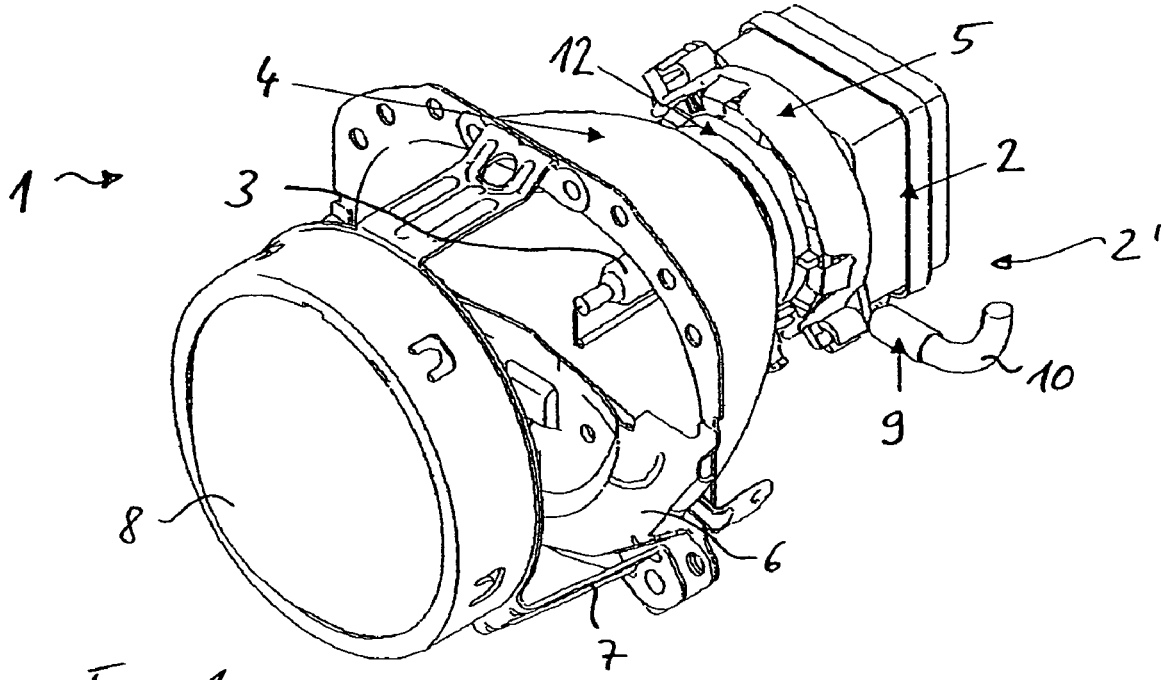
Figur 1
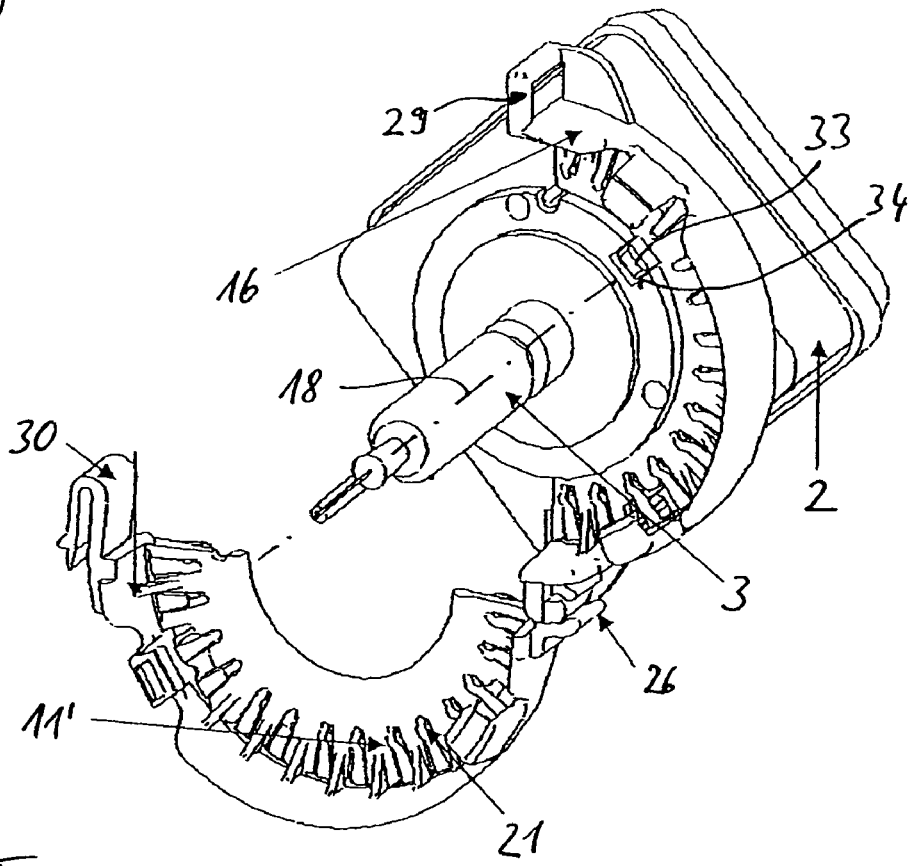
Figur 2

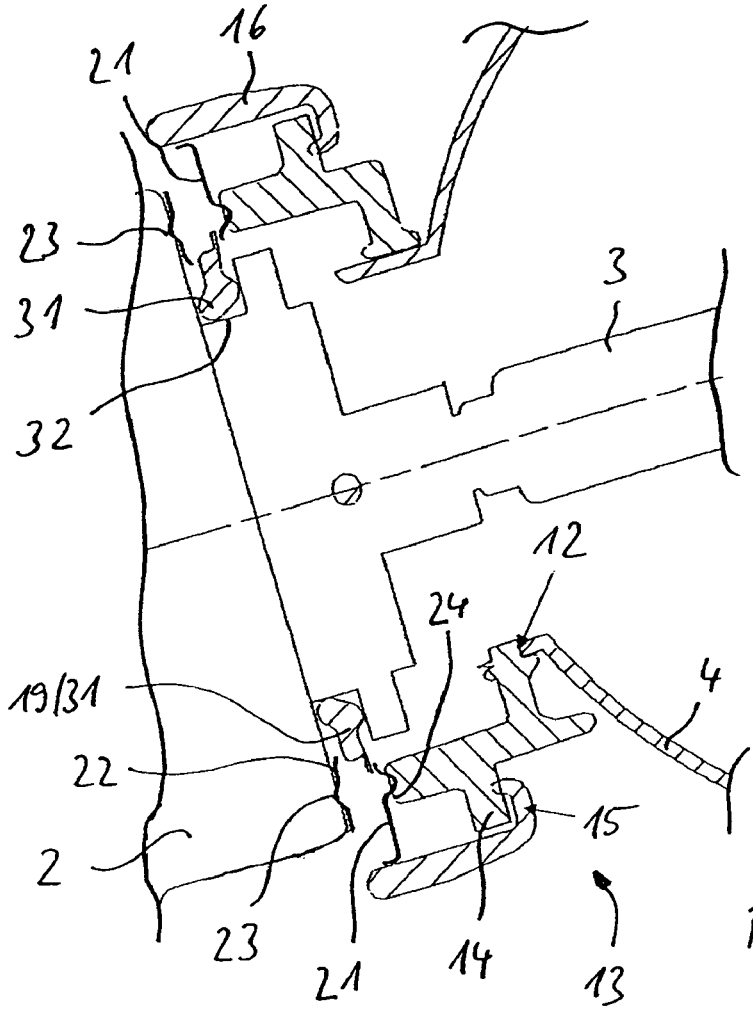
Figur 3
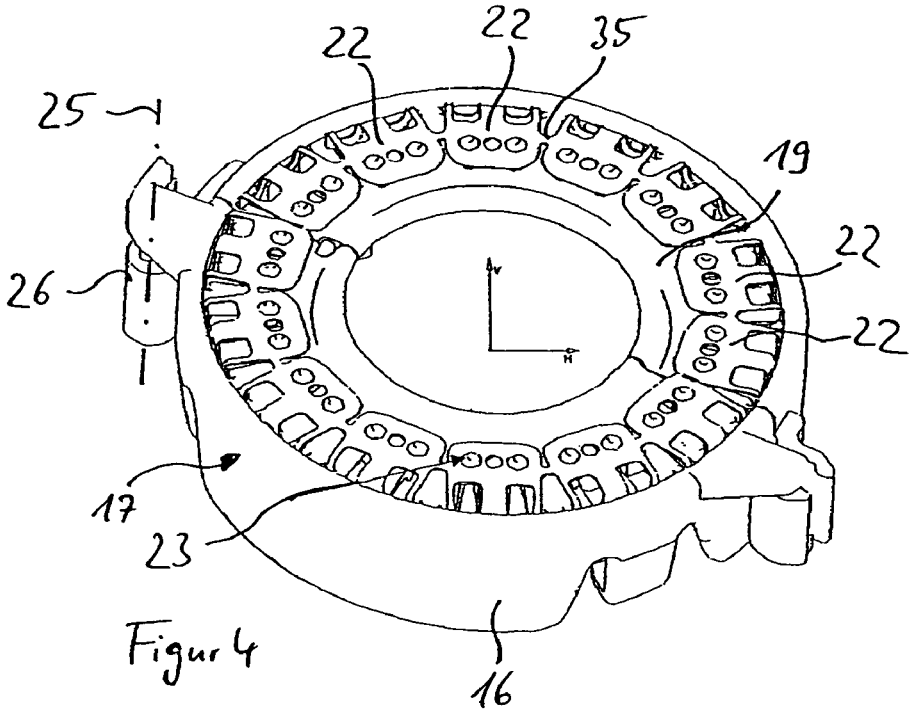
Figur 4

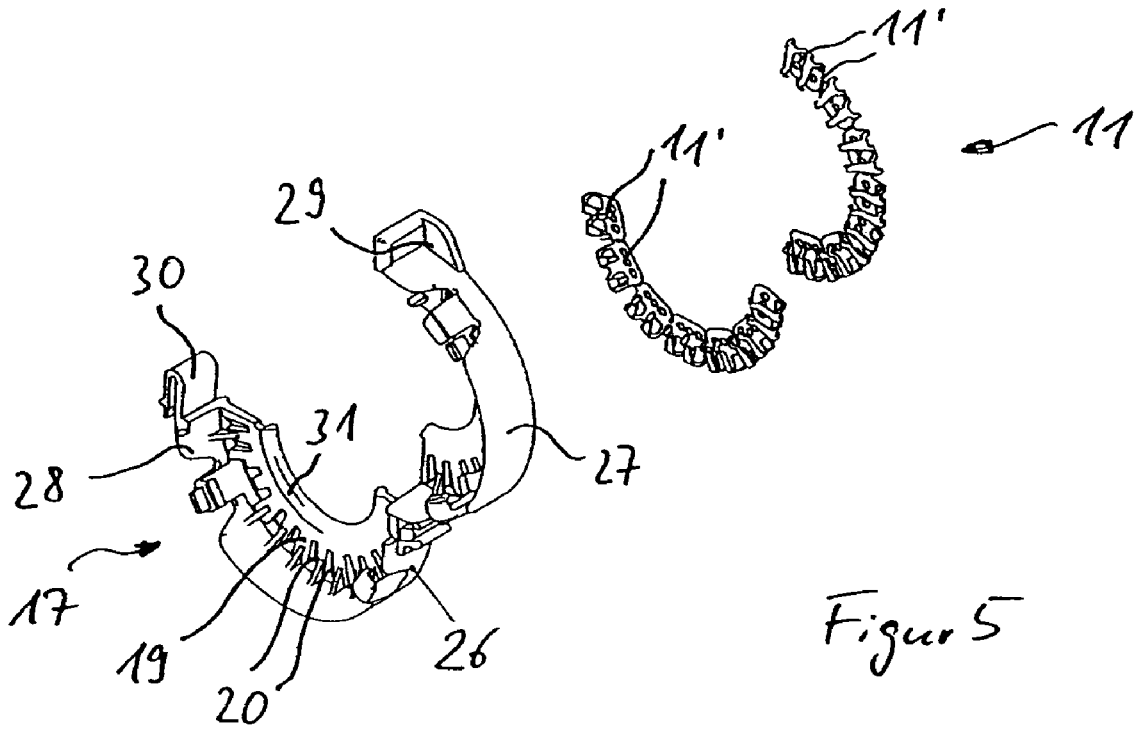
Figur 5

HEADLAMP FOR VEHICLES

CROSS-REFERENCE TO RELATED APPLICATIONS

This application is a National Stage of International Application No. PCT/EP2004/005351, filed May 18, 2004. This applications claims the benefit of German Patent Application No. 103 22 627.3, filed May 20, 2003.

BACKGROUND OF THE INVENTION

1. Field of the Invention

The invention concerns a headlamp for vehicles with a reflector comprising a reflector opening for receiving a gas discharge lamp, with an ignition device for operating the gas discharge lamp, with holding means for releasably connecting the ignition device to a reflector, with electromagnetically compatible contact means arranged between the ignition device and the reflector.

2. Related Art

From DE 202 08 295 U1 is known a headlamp for vehicles with a reflector, a gas discharge lamp and an ignition device, in which the ignition device and the gas discharge lamp form a common unit. For electromagnetically shielding the junction between the lamp/ignition device unit and the reflector there is provided as the electromagnetically compatible contact means an electromagnetically compatible shield plate which is ring-shaped and arranged between a surface of the reflector neck and a surface of the ignition device. The electromagnetically compatible shield plate has mounting openings to which is attached a holding spring. The holding spring is fitted by means of an adapter part arranged on the rear side of the ignition device, so that there is a rigid connection between the lamp/ignition device unit and the reflector. A drawback of the known headlamp is that, to fix the lamp/ignition device unit with the reflector, several holding means must be provided, namely the stirrup-shaped holding spring, the adapter part and the electromagnetically compatible shield plate.

From U.S. Pat. No. 6,390,657 B1 is known a headlamp for vehicles, in which a socket of the gas discharge lamp is connected to a reflector. The lamp socket has flexible tabs which with their free ends extend in a rearward direction and form reliable electrical contacting with a plug arranged on the rear side of the socket. From U.S. Pat. No. 6,474,856 B2 is known a headlamp for vehicles with a reflector, a gas discharge lamp and an ignition device, in which the ignition device and the gas discharge lamp form a common unit. As holding means for fastening the reflector to the ignition device, bell-shaped holding elements extend rearwardly from the reflector neck. For electromagnetic shielding, electromagnetically compatible contact means are designed as metal clips which encompass the reflector neck and a peripheral surface of the ignition device in a frame-like, clamp-like fashion.

From DE 201 07 817 U1 is known a headlamp for vehicles with a reflector, a gas discharge lamp arranged in an opening of the reflector and an ignition device, wherein on the ignition device on the one hand and in the region of the reflector opening on the other hand are provided holding means for the releasable connection of the ignition device to the reflector. The holding means comprise latch hooks or latch surfaces, such that the ignition device is connected to the reflector by a bayonet fastening. The gas discharge lamp is attached to the reflector by means of a receiving device in the region of the reflector opening. For electromagnetic shielding of the junction between the ignition device and the reflector there is provided an electromagnetically compatible contact means which is constructed as a spring washer and arranged in planar fashion between a housing of the ignition device and a surface of the reflector neck. The spring washer is flexible and undulating in the direction of rotation, so that it adapts in the sense of good contacting between the mutually facing surfaces of the ignition device and the reflector neck. A drawback of the known headlamp is that the electromagnetically compatible contact means must additionally be kept ready for assembly of the headlamp.

SUMMARY OF THE INVENTION

It is the object of the invention to develop a headlamp for vehicles in such a way that the expenditure on fastening including in particular the electromagnetically compatible contact means is further reduced.

To achieve this object, the invention is a headlamp for vehicles with a reflector comprising a reflector opening for receiving a gas discharge lamp, and ignition device for operating the gas discharge lamp, holding means for releasably connecting the ignition device to a reflector and an electromagnetically compactible contact means arranged between the ignition device and the reflector, characterised in that the holding means includes a holding element which together with the ignition device and the gas discharge lamp forms a common unit, and in that the electromagnetically compatible contact means is integrated in the holding element, in such a way that, in a locking position of the holding element with the reflector, there is an electrically conductive connection between the ignition device and the reflector.

The particular advantage of the invention lies in that assembly or dismounting of the gas discharge lamp connected to the ignition device is simplified. According to the invention, the electromagnetically compatible contact means forms part of a holding element which is preferably releasably connected to the ignition device and/or the socket of the gas discharge lamp. Advantageously, the holding element forms a receptacle for the electromagnetically compatible contact means, so that there is simplified fastening both of the gas discharge lamp and of the ignition device to the reflector. Due to the defined position of the electromagnetically compatible contact means on the holding element, there is reliable contacting between the ignition device and the reflector in the locking position of the holding element.

According to a preferred embodiment of the invention, the holding element is ring-shaped. It is arranged coaxially with the longitudinal axis of the gas discharge lamp. Further, the holding element comprises fastening means for releasable connection to a neck of the reflector. Preferably, the fastening means are constructed in such a way that the holding element forms part of a bayonet fastening. As a result, easy and reliable fastening of the gas discharge lamp/ignition device to the reflector can be ensured.

According to a development of the invention, the holding element comprises several recesses distributed in turret fashion, through which in each case electromagnetically compatible contact elements engage in clamping relationship. Advantageously, several electromagnetically compatible contact elements are integrally connected to each other. Advantageously, the electromagnetically compatible contact elements are held captive on the holding element.

According to a preferred embodiment of the invention, the holding element is constructed as a holding ring which has functional elements, such that at least part of the holding ring is arranged so as to be movable in the plane of its main extent.

In this way, easy release and connection of the holding ring to the ignition device and/or gas discharge lamp is ensured.

According to a development of the invention, the holding ring is positioned so that it can engage in an annular groove of the ignition device and/or lamp socket, so that there is reliable locking in an axial direction. By functional fastening elements of the holding ring itself, it is locked in a radial direction.

According to a preferred embodiment of the invention, the holding ring has fastening elements, such that a ring segment of the holding ring is designed to be pivotable about a pivot axis of the holding ring arranged parallel to the longitudinal axis of the gas discharge lamp. Preferably, the fastening elements are firstly formed by a joint on which two semicircular ring segments of the holding ring are mounted. Secondly, the fastening element is a latch lock with latch means which are arranged at an end of the semicircular ring segments of the holding ring facing away from the joint, and cause latch connection of these ends of the ring segments.

According to an alternative embodiment, the holding ring has two ring segments which are coupled together via a spring element. Release or fastening of the holding ring is in this case effected by pulling the two ring segments apart.

According to a development of the invention, the holding element has an axial bayonet ring with fastening means such that, after fastening the holding element to the ignition device and/or lamp socket, the lamp/ignition device unit can be connected to the reflector by means of a bayonet fastening. The holding element thus combines several fastening functions. Firstly, it has recesses for clamping fastening of the electromagnetically compatible contact element. Secondly, it even has fastening means, so that it can be engaged in locking fashion in an annular groove of the ignition device or lamp socket. Thirdly, the holding element has a bayonet ring by means of which there is a rigid and reliable connection of the ignition device or gas discharge lamp to the reflector.

According to a development of the invention, the holding element is designed as a plastic part, so that there is thermal insulation. Further, the holding element serves for tolerance compensation of non-planarities in the region of the junction.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

Practical examples of the invention are described ~n more detail below with the aid of the drawings.

Figure 6:
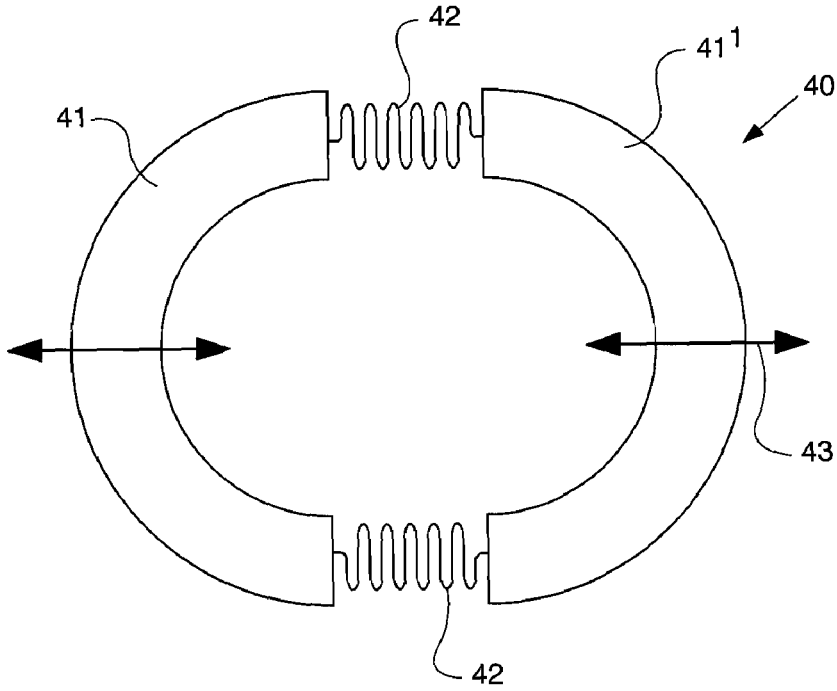
Figure 7:
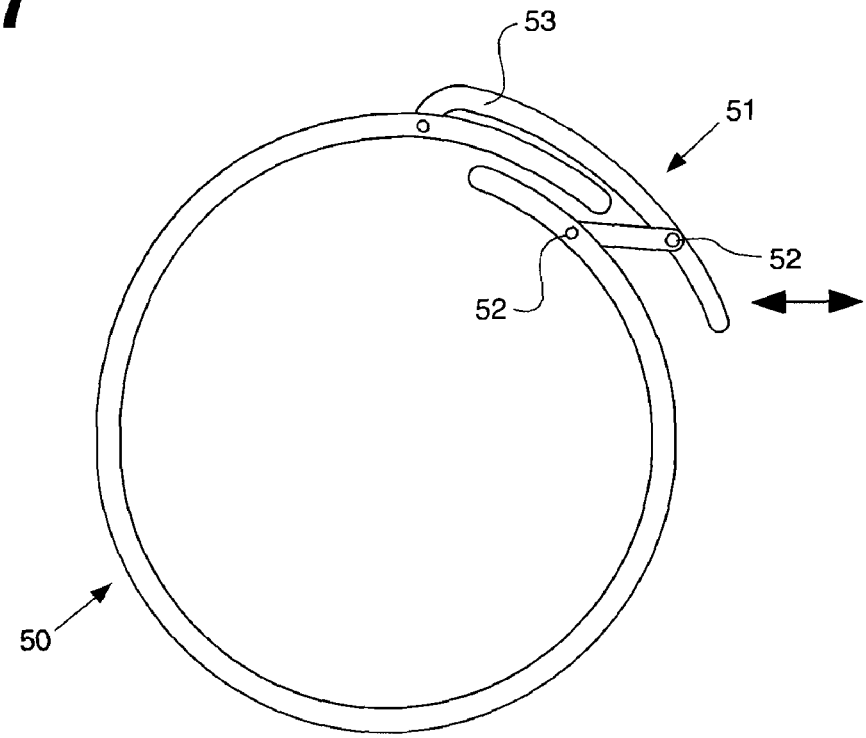

They show:

FIG. 1 is a perspective view of a projection module from the front for a headlamp, FIG. 2 is a perspective view of a lamp/ignition device unit with an open holding element, FIG. 3 is a partial cross-section through the headlamp, FIG. 4 is a rear view of a holding element which is fastened in an annular groove of the ignition device, FIG. 5 is a perspective view of the annular holding element and of electromagnetically compatible contact elements, the holding element being in an open state, FIG. 6 is a schematic front view of a holding element according to a second embodiment, and FIG. 7 is a schematic front view of a holding element according to a third embodiment

DETAILED DESCRIPTION OF THE PREFERRED EMBODIMENTS

The following description of the preferred embodiment(s) is merely exemplary in nature and is in no way intended to limit the invention, its application, or uses.

A headlamp 1 for vehicles essentially consists of a projection module with a gas discharge lamp 3 rigidly connected to an ignition device 2, a reflector 4 as well as holding means 5 for releasably fastening the ignition device 2 to the reflector 4 as well as electromagnetically compatible contact means 11 for electromagnetic shielding of the junction between the ignition device 2 and the reflector 4.

The headlamp 1 as in FIG. 1 works on the projection principle and moreover has a stop device 6 as well as a lens 8 mounted in a lens holder 7. From the ignition device 2 via an electromagnetically compatibly shielded plug 9 an electrical connecting wire 10 leads to a remotely mounted control unit, not shown, for generating an operating current. The operating current is necessary in order to generate in the ignition device 2 the high voltage required for ignition of the gas discharge in the lamp 3.

For releasable connection of the ignition device/gas discharge lamp unit 2' to a neck 12 of the reflector 4, a bayonet fastening 13 is provided. To form the bayonet fastening 13, firstly the reflector neck 12 has stops, not shown, and ring segments 14 behind which engage L-shaped holding projections 15 distributed in the circumferential direction. The holding projections 15 form part of a bayonet ring 16 which is part of a holding element 17 shown in FIG. 4.

The holding element 17 is ring-shaped and has a holding ring 19 extending perpendicularly to a longitudinal axis 18 of the gas discharge lamp 3, as well as the bayonet ring 16 adjoining the outer peripheral surface of the holding ring 19 at the front. The holding ring 19 has a plurality of recesses 20 distributed in turret fashion in the circumferential direction, in which the electromagnetically compatible contact means 11 can be inserted in clamping relationship from a rear side of the holding ring 19. As can be seen better from FIG. 5, the electromagnetically compatible contact means 11 are formed by a plurality of electromagnetically compatible contact elements 11' which are integrally connected to each other and form a partial ring. The electromagnetically compatible contact elements 11' are in each case clamp-shaped and firstly have a spring tab 21 which engages in the recess 20 of the holding ring 19. Secondly, the electromagnetically compatible contact element 11' has a flat contact face 22 which abuts in planar fashion firstly against a rear side of the holding ring 19 and secondly against a side of the ignition device 2 facing towards the reflector neck 12, see FIG. 3. To improve contacting with the electrically conductive outer casing of the ignition device 2, the contact face 22 has bulges or contact buttons 23 projecting towards the ignition device 2.

As can be seen from FIG. 3, the spring tabs 21 protrude from the plane of the holding ring 19 and press against a radial and continuous edge surface 24 of the reflector neck 12. As a result, reliable contacting is ensured in a locking position of the holding element 17.

The reflector neck 12 is, like the reflector 4 made of die-cast aluminum, made of an electrically conductive material. Alternatively, the reflector 4 may be made of sheet metal as a deep-drawn component.

As can be seen from FIGS. 4 and 5, the holding element 17 has functional elements, so that it can be opened about a pivot axis 25. The pivot axis 25 extends parallel to the longitudinal axis 18 of the lamp 3 and is formed by a joint 26, so that a first ring segment 27 of the holding element 17 is arranged so as to be pivotable relative to a second ring segment 28 thereof. The first ring segment 27 and the second ring segment 28 have a latch opening 29 or a latch tab 30 at an end facing away from the joint 26, so that the ring segments 27, 28 are axially locked after engagement thereof with abutment of an inner ring section 31 thereof in an annular groove 32 of the ignition device 2. The thickness of the inner ring section 31 is selected such that it is mounted with play in the annular groove 32. The inner ring section 31 has at least one axially projecting fastening projection 33 which engages in a corresponding recess 34 of the lamp socket 3.

As can be seen from FIG. 2, assembly of the holding element 17 with the ignition device 2 takes place by engagement of the first ring segment 27 in the annular groove 32, the holding element 17 being in an open position. Subsequently the second ring segment 28 is moved in the direction of the first ring segment 27 with engagement of the inner ring section 31 in the annular groove 32, until the holding element 17 is in the closed position by means of latch connection of the latch tab 30 and the latch opening 29. The annular electromagnetically compatible contact means 11 have been inserted in the corresponding recesses 20 of the holding ring 19 in clamping relationship beforehand.

According to an alternative embodiment, not shown, the electromagnetically compatible contact means 11 can also be constructed as a corrugated washer which is attached to the holding ring 9 in clamping relationship and has bulges in the direction of front and rear sides.

The distances between the electromagnetically compatible contact elements 11' connected to each other by a connecting web 35 is relatively small so that there is comprehensive electromagnetic shielding. The length of the connecting webs 35 is preferably a few millimeters, preferably less than 5 mm.

In the embodiment mentioned, both the holding ring 19 and the bayonet ring 16 are made of plastic material in one piece.

According to one embodiment, not shown, the bayonet ring can be made of metal or have a metal coating to improve the electromagnetic shielding.

To assemble the headlamp 1, the unit 2' composed of the ignition device 2, the gas discharge lamp 3 and the holding element 17 is connected to the reflector 4. The holding element 17 is non-rotatably connected to the ignition device 2. The bayonet ring 16 engages by its forwardly projecting holding projections 15 between the radial ring segments 14 of the reflector neck 12. By subsequently turning the ignition device 2 relative to the reflector 4 about the longitudinal axis 18 of the gas discharge lamp 3, locking of the holding element 17 or ignition device 2 to the reflector 4 takes place with clamping abutment of the holding projections 15 on the front side of the ring segments 14. In the usual manner the holding element 17 is turned together with the ignition device 2 and the gas discharge lamp 3 through an angle of about 45, in order to move into the locking position.

The headlamp 1 formed in this way can now be assembled with a housing, not shown, in an opening, not shown, provided in the vehicle body.

To change the lamp, the unit 2' is removed from the housing of the headlamp 1, the gas discharge lamp 3 is exchanged and then the unit 2' is reassembled in the housing of the headlamp 1.

According to a second embodiment of a holding element 40 as in FIG. 6, it can be formed by two ring segments 41, 41' which are connected to each other at their ends in each case by a spring element 42. By applying a force 43 in the direction of action of the spring elements 42, the holding element 40 can be moved into an open position or closed position.

According to a third embodiment as in FIG. 7, a holding element 50 is designed as a holding ring which has a control rod 51 in a ring section for moving the holding element 50 can be moved into closed and open positions. The control rod 51 has at least two joints 52 and an outer clamp 53 by means of which a snap-fit closed position of the "open" holding ring 50 is made possible.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A headlamp for vehicles comprising:

a reflector comprising a reflector opening for receiving a gas discharge lamp, an ignition device for operating the gas discharge lamp, a holder for releasably connecting the ignition device to a reflector, an electromagnetically compatible contact arranged between the ignition device and the reflector, wherein the holder includes a holding element (17) which together with the ignition device (2) and the gas discharge lamp (3) forms a common unit (2'), and in that the electromagnetically compatible contact (11) is integrated in the holding element (17), such that, in a locking position of the holding element (17) with the reflector (4), there is an electrically conductive connection between the ignition device (2) and the reflector (4); and wherein the holding element (17) comprises several recesses (20) distributed in turret fashion, in which in each case electromagnetically compatible contact elements (11') are positioned in clamping relationship.

2. Headlamp according to claim 1, characterised in that the holding element (17) is ring-shaped and arranged coaxially with a longitudinal axis (18) of the gas discharge lamp (3), and in that the holding element (17) comprises fastening means (15, 16) for releasable connection to a neck (12) of the reflector (4).

3. A headlamp according to claim 1, characterised in that the holding element (17) is divided into at least one first ring segment (27) and a second ring segment (28), with a joint such that the first ring segment (27) and/or the second ring segment (28) is designed to be pivotable about a pivot axis (25).

4. A headlamp according to claim 1, characterised in that the holding element (40) has at least two ring segments (41, 41') which are coupled together via at least one spring element (42), and in that the direction of action of the spring element (22) is oriented perpendicularly to the longitudinal axis (18) of the gas discharge lamp (3).

5. A headlamp according to claim 1 characterised in that the holding element (50) has a control rod (51) by means of which the holding element can be moved into at least two positions of different circumferential length.

6. A headlamp according to claim 1 characterised in that the holding element (17, 40, 50) has a bayonet ring (16) by means of which locking to the reflector neck (12) can be effected.

7. A headlamp according to claim 1 characterised in that the holding ring (19) and the bayonet ring (16) are connected to each other in one piece and designed as a plastic part.

8. A headlamp for vehicles comprising:

a reflector comprising a reflector opening for receiving a gas discharge lamp, an ignition device for operating the gas discharge lamp, a holder for releasably connecting the ignition device to a reflector, an electromagnetically compatible contact arranged between the ignition device and the reflector, wherein the holder includes a holding element (17) which together with the ignition device (2) and the gas discharge lamp (3) forms a common unit (2'), and in that the electromagnetically compatible contact (11) is integrated in the holding element (17), such that, in a locking position of the holding element (17) with the reflector (4), there is an electrically conductive connection between the ignition device (2) and the reflector (4); and the holding element (17) on the one hand has a holding ring (19) for receiving the electromagnetically compatible contact (11) and on the other hand has fastening elements (26, 29, 30), such that at least part of the holding ring (19) is arranged so as to be movable in a plane arranged perpendicularly to the longitudinal axis (18) of the gas discharge lamp (3), for release and connection of the holding ring (19) to the ignition device (2) and/or to the gas discharge lamp (3).

9. A headlamp according to claim 8, characterised in that the holding element (17) ring-shaped and arranged coaxially with a longitudinal axis (18) of the gas discharge lamp (3), and in that the holding element (17) comprises fastening means (15, 16) for releasable connection to a neck (12) of the reflector (4).

10. A headlamp according to claim 8, characterised in that the holding element (17) is divided into at least one first ring segment (27) and a second ring segment (28), with a joint such that the first ring segment (27) and/or the second ring segment (28) is designed to be pivotable about a pivot axis (25).

11. A headlamp according to claim 8, characterised in that the holding element (40) has at least two ring segments (41, 41') which are coupled together via at least one spring element (42), and in that the direction of action of the spring element (22) is oriented perpendicularly to the longitudinal axis (18) of the gas discharge lamp (3).

12. A headlamp according to claim 8, characterised in that the holding element (50) has a control rod (51) by means of which the holding element can be moved into at least two positions of different circumferential length.

13. A headlamp according to claim 8, characterised in that the holding element (17, 40, 50) has a bayonet ring (16) by means of which locking to the reflector neck (12) can be effected.

14. A headlamp according to claim 8, characterised in that the holding ring (19) and the bayonet ring (16) are connected to each other in one piece and designed as a plastic part.

15. A headlamp for vehicles comprising:

a reflector comprising a reflector opening for receiving a gas discharge lamp, an ignition device for operating the gas discharge lamp, a holder for releasably connecting the ignition device to a reflector, an electromagnetically compatible contact arranged between the ignition device and the reflector, wherein the holder includes a holding element (17) which together with the ignition device (2) and the gas discharge lamp (3) forms a common unit (2'), and in that the electromagnetically compatible contact (11) is integrated in the holding element (17), such that, in a locking position of the holding element (17) with the reflector (4) there is an electrically conductive connection between the ignition device (2) and the reflector (4); and the holding ring (19) has an inner ring section (31), such that the holding element (17) engages in clamping relationship in an annular groove (32) of the ignition device (2) and/or lamp socket (3).

16. A headlamp according to claim 15, characterised in that the holding element (17) is ring-shaped and arranged coaxially with a longitudinal axis (18) of the gas discharge lamp (3), and in that the holding element (17) comprises fastening means (15, 16) for releasable connection to a neck (12) of the reflector (4).

17. A headlamp according to claim 15, characterised in that the holding element (17) is divided into at least one first ring segment (27) and a second ring segment (28), with a joint such that the first ring segment (27) and/or the second ring segment (28) is designed to be pivotable about a pivot axis (25).

18. A headlamp according to claim 15, characterised in that the holding element (40) has at least two ring segments (41, 41') which are coupled together via at least one spring element (42), and in that the direction of action of the spring element (22) is oriented perpendicularly to the longitudinal axis (18) of the gas discharge lamp (3).

19. A headlamp according to claim 15, characterised in that the holding element (50) has a control rod (51) by means of which the holding element can be moved into at least two positions of different circumferential length.

20. A headlamp according to claim 15, characterised in that the holding element (17, 40, 50) has a bayonet ring (16) by means of which locking to the reflector neck (12) can be effected.

21. A headlamp according to claim 15, characterised in that the holding ring (19) and the bayonet ring (16) are connected to each other in one piece and designed as a plastic part.

* * * * *